US005138748A

United States Patent [19]

Welles

[11] Patent Number: 5,138,748

[45] Date of Patent: Aug. 18, 1992

[54] BAG CLOSURE

[76] Inventor: Theodore W. Welles, 32485 Creekside Dr., Pepper Pike, Ohio 44124

[21] Appl. No.: 747,149

[22] Filed: Aug. 19, 1991

[51] Int. Cl.[5] ..... B65D 77/10

[52] U.S. Cl. ..... 24/30.55; 24/555; 24/563

[58] Field of Search ..... 24/30.5 S, 30.5 R, 30.5 C, 24/67.9, 67 R, 545, 555, 556, 562, 563, DIG. 28

[56] References Cited

U.S. PATENT DOCUMENTS

| | | | |
|---|---|---|---|
| 2,639,691 | 5/1953 | Zurlo | 24/562 X |
| 2,960,737 | 11/1960 | Kirsch et al. | 24/562 X |
| 3,086,264 | 4/1963 | Tindall | 24/30.5 |
| 3,164,250 | 1/1965 | Paxton | 206/56 |
| 3,270,874 | 9/1966 | Hilton | 206/56 |
| 3,822,441 | 7/1974 | Paxton | 24/30.5 |
| 3,962,757 | 6/1976 | Gedney | 24/30.5 S X |
| 4,571,779 | 2/1986 | Koerschner et al. | 24/30.5 X |
| 4,644,610 | 2/1987 | Fish | 24/30.5 S |
| 4,760,624 | 8/1988 | Fish | 24/30.5 |
| 4,858,285 | 8/1989 | Dala et al. | 24/545 X |

FOREIGN PATENT DOCUMENTS 1238386 4/1967 Fed. Rep. of Germany ... 24/30.5 R

*Primary Examiner*—James R. Brittain

*Attorney, Agent, or Firm*—Body, Vickers & Daniels

[57] ABSTRACT

A closure for closing the folded open end of a bag comprises a tri-laminate of thin relatively rigid plastic material having planar opposite sides and an edge therebetween. The closure is provided with an opening through the opposite sides of the tri-laminate and an entrance passage to the opening from the edge and which entrance passage has a non-linear profile in the direction between the opposite sides of the tri-laminate. The closed end of a bag is introduced into the opening through the entrance passage which distorts the folded end of the bag to the non-linear profile, thereby frictionally holding the closure on the bag and perpendicular to the crease line of the fold.

28 Claims, 4 Drawing Sheets

BAG CLOSURE

BACKGROUND OF THE INVENTION

This invention relates to the art of bag closures and, more particularly, to a closure for the folded open end of a paper or plastic bag.

It is of course well known to close the open end of a bag of paper or plastic material by folding the open end to form a flap and then clamping the flap against the side of the bag, such as by use of a spring clip or a resilient U-shaped clip such as that disclosed in U.S. Pat. No. 3,086,264 to Tindall. Such closures are generally used in conjunction with storing the contents of a bag following the opening thereof and serve to preclude the spillage of the bag contents and to reduce the exposure of the contents to air, moisture, dirt and other contaminants during such periods of storage.

While resilient plastic or spring clips of the foregoing character serve their intended purpose with respect to closing the open end of a bag, they are large and undesirably expensive and undesirably space consuming with respect to storage in numbers. Furthermore, the size and cost of such clips precludes their being offered as a closure component accompanying the bag and its contents at the time of sale whereby, if a person does not have such a clip available, he or she is left with alternatives such as storing the contents of the bag in another storage container following opening of the bag, or merely folding the open end of the bag a number of times and pressing the seams of the folds in an effort to retain the latter in a closed disposition. Often, especially with resilient plastic bags, such folding is immediately followed by unfolding due to the resiliency of the bag material.

SUMMARY OF THE INVENTION

A bag closure is provided in accordance with the present invention which is relatively small and inexpensive to manufacture, and which can be readily applied to the folded end of a paper or plastic bag to securely hold the folded end closed without slippage from the bag. Further, the closure is of a size and cost which enables the closure, if desired, to be marketed as an attachment to a bag to provide for closing the bag after opening thereof and during continued use thereof. More particularly in this respect, a closure in accordance with the present invention has opposite sides and is relatively thin with respect to the distance therebetween and is adapted to be introduced onto the folded closed end of a bag with the sides of the closure transverse to the seam of the fold. The closure distorts the bag material adjacent the seam to a non-linear profile which holds the bag closed and resists angular displacement of the closure relative to its transverse disposition, thus to restrain sliding separation of the closure from the bag. The foregoing interengaging relationship between the bag and closure in accordance with the present invention is achieved by providing the closure with an opening to receive the end of the bag and with an entrance passage to the opening which has a non-linear profile in the direction between the opposite sides of the closure.

In accordance with one aspect of the present invention, a closure providing the foregoing opening and entrance passage profile can be constructed from prior art bag closure members of the type used for maintaining the constricted necks of plastic bags closed. These closure members, as is well known, are constructed of a single ply of thin, flat and relatively rigid plastic material and have an opening therethrough and an entrance passage to the opening from one edge of the closure. The opening and entrance passage in such prior art single ply closure members are symmetric with respect to the center point or the one edge of the closure. In accordance with one embodiment of the invention, three such closure members are positioned in parallel, side-by-side relationship with the openings and entrance passages of the outer two closure members in alignment with one another and with the opening and entrance passage of the intermediate closure member offset relative to the outer two closure members in the direction transverse to the entrance passages of the three closure members. The three closure members are interconnected in this relationship, and the offset therebetween provides for the entrance passage to have a non-linear profile in the direction between the opposite sides of the closure as defined by the outer closure members. In accordance with another embodiment, single ply closure members are constructed with the opening and entrance passage offset from the center point of the edge from which the entrance passage extends. In this embodiment, the non-linear profile for the entrance passage is obtained by reversing the orientation of the offset of the intermediate closure member relative to the outer two closure members.

The width of the entrance passage as well as the offset between the entrance passages of the outer and intermediate closure members can vary so that the closures can be used with bag materials ranging in thickness from extremely thin polyethylene to heavier paper materials. Preferably, the three closure members are interconnected such that the areas thereof adjacent the entrance passage, on the side thereof in the direction of the offset, are not connected together. The portions of the outer closure members in this area of the entrance passage are therefore adapted to flex laterally outwardly relative to the plane of the intermediate member. This, in effect, spreads the entrance passage in the direction between the opposite sides of the closure, thus to further stabilize the closure against twisting and against sliding separation from a bag to which the closure has been applied.

It will be appreciated that a bag closure according to the invention is thin relative to its length and width dimensions and is of a size which can be attached to a commercial package, such as by tape for example, to provide the consumer with a closure for the packaged material when purchased.

It is accordingly an outstanding object of the present invention to provide a new and unique closure for the folded open end of a bag.

Another object is the provision of a closure of the foregoing character which can be mounted on the folded, closed end of a bag transverse to the direction of the folded seam to distort the seam to a non-linear profile, thus to restrain turning of the closure relative to its transverse disposition and to restrain sliding displacement of the closure from the bag.

A further object is the provision of a closure of the foregoing character which is thin relative to its length and width dimensions and which is easy to manipulate into its use position on the closed end of a bag and which, when in its use position, is stable against unintended displacement relative to the bag, both with respect to its mounted disposition and its removal from the bag.

Yet another object is the provision of a closure of the foregoing character which is relatively small, structurally simple and economical to produce.

Still a further object is the provision of a closure of the foregoing character which is relatively thin and which is characterized by an opening therethrough and an entrance passage to the opening having a non-linear profile in the direction between the opposite sides of the closure.

Yet a further object is the provision of a closure of the foregoing character in the form of a tri-laminate of closure members each having an opening therethrough and an entrance passage to the opening and wherein the closure members are interconnected for the opening and entrance passage of the intermediate member to be offset relative to the openings and entrance passages of the outer members, thus providing an entrance passage having a non-linear profile in the direction between the opposite sides of the closure as defined by the outer closure members.

BRIEF DESCRIPTION OF THE DRAWINGS

The foregoing objects, and others, will in part be obvious and in part pointed out more fully hereinafter in conjunction with the written description of preferred embodiments in the accompanying drawings in which.

DESCRIPTION OF PREFERRED EMBODIMENTS

Figure 1:
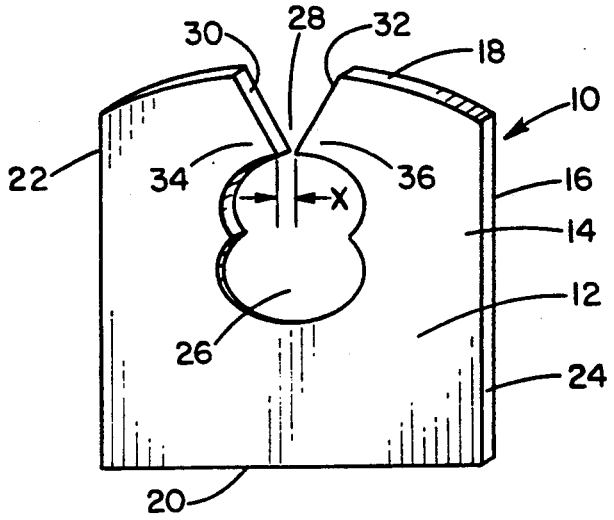
FIG. 1 (PRIOR ART)
FIG. 1 is a perspective view of a prior art single ply bag closure member.

Referring now in greater detail to the drawings wherein the showings are for the purpose of illustrating preferred embodiments of the invention only and not for the purpose of limiting the invention, FIG. 1 illustrates a prior art bag closure member 10 of the type adapted to receive the constricted neck of a bag of thin plastic material such as polyethylene to close the bag. As is well known, such closure members generally have a thickness of between about 0.02 to 0.08 inch and are made from a relatively rigid plastic material such as polystyrene, polyethylene, polyproplene or polyvinyl chloride, for example. Such closure members include a body portion 12 having planar opposite sides 14 and 16 and a peripheral edge between the opposite sides which, in the embodiment illustrated and in the orientation shown in FIG. 1, includes a top edge 18, a bottom edge 20 and opposite end edges 22 and 24. The width of the closure member between edges 22 and 24 may, for example, be about 0.85 inch, and the height between edges 18 and 20 can vary from about 0.80 inch to 1.5 inch. For purposes of size and appearance, it is preferred in connection with the present invention to have the height dimension between about 0.80 to 0.90 inch. An opening 26 is provided through the body portion between opposite sides 14 and 16, and an entrance passage 28 is provided for opening 26 from top edge 18. The opening and entrance passage are symmetric with respect to the center point between the opposite ends of top edge 18. Access to entrance passage 28 from edge 18 is provided by inclined walls 30 and 32 which converge in the direction from edge 18 toward opening 26 and intersect the latter to provide the body portion with opposed fingers 34 and 36 which define entrance passage 28. The opposed inner ends of fingers 34 and 36 are spaced apart a distance x which, for example, may be from about 0.022 to 0.032 inch. The dimension x varies to facilitate introduction of a bag neck into opening 26 in accordance with the cross-sectional dimension of the constricted neck of a given bag, and the circumferential configuration and dimensions of opening 26 vary for the same reason.

Figure 2:
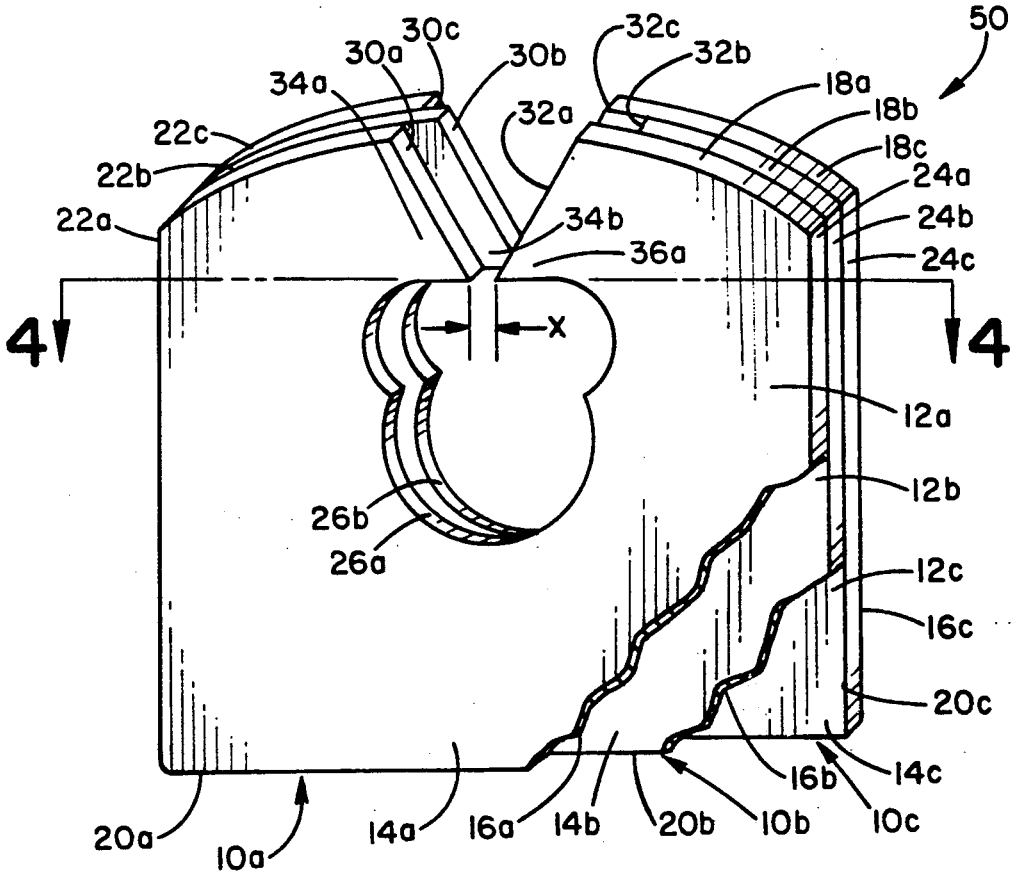
FIG. 2 is a perspective view of one embodiment of a bag closure in accordance with the present invention.
Figure 3:
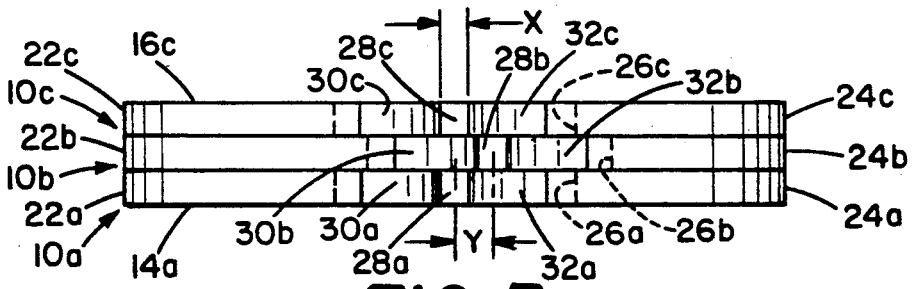
FIG. 3 is a top view of the bag closure shown in FIG. 2.
Figure 4:
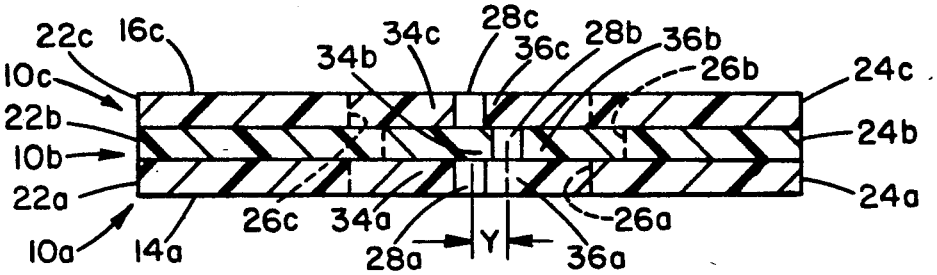
FIG. 4 is a cross-sectional view of the bag closure taken along line 4—4 in FIG. 2.

In accordance with one embodiment of the present invention, a bag closure 50 is constructed from three closure members 10 structurally interrelated as shown in FIGS. 2–4 of the drawing. More particularly in this respect, the three bag closure members, designated 10*a*, 10*b* and 10*c*, are disposed in side-by-side relationship and interconnected as described more fully hereinafter to provide a tri-laminate bag closure comprising outer closure members 10*a* and 10*c* and intermediate closure member 10*b*. Certain of the component parts of the three closure members correspond to those described above in connection with FIG. 1 and, accordingly, like numerals are used in FIGS. 2–4 with the designation a, b or c to indicate the corresponding one of the individual closure members. As will be appreciated from FIGS. 2–4, closure 50 has a body portion defined by the body portions 12*a* 12*b* and 12*c* of the individual closure members and has opposite sides 14*a* and 16*c* defined by the outer sides of closure members 10*a* and 10*c*. Further, closure 50 has peripheral edge portions defined by the corresponding edge portions of the three closure members, an opening through the body portion defined by openings 26*a*, 26*b* and 26*c* through the individual closure members, and an entrance passage to the opening defined by the individual entrance passages 28*a*, 28*b* and 28*c* of the closure members.

As will be further appreciated from FIGS. 2–4, the closure members 10*a*, 10*b* and 10*c* are positioned relative to one another such that entrance passage 28*b* of intermediate closure member 10*b* is offset a distance y relative to entrance passages 28*a* and 28*c* of the outer closure members 10*a* and 10*c* in the direction between the end edges of the individual closure members. Since the openings and entrance passages of the three closure members are symmetric with respect to the opposite ends of the top edges thereof, it will be appreciated that the offset, in connection with the orientation shown in FIGS. 2–4, would provide for end edge 24b of intermediate closure member 10b to extend to the right of end edges 24a and 24c of the outer closure members and for the opposite end edge 22b of the intermediate closure member to be spaced inwardly of edges 22a and 22c of the outer closure members. Preferably, for purposes of appearance, the projecting portion of end edge 24b and the projecting portions of end edges 22a and 22c are removed for the opposite end edges of closure 50 to be coplanar as shown. Alternatively, intermediate closure member 10b could be initially dimensioned to provide the desired offset relationship relative to the outer closure members and to provide the coplanar end edge relationship without having to remove any material from the individual closure members.

Figure 5:
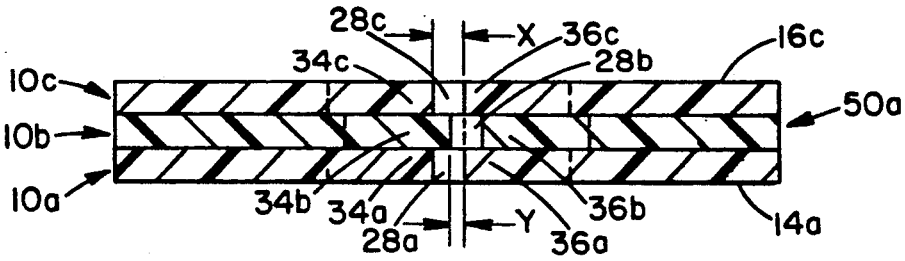
FIG. 5 is a cross-sectional view similar to FIG. 4 and illustrating a modification of the component parts of the closure.

The offset relationship between the outer and intermediate closure members provides an entrance passage to the opening through closure 50 which is defined by the individual entrance passages 28a, 28b and 28c and which entrance passage, because of the offset, has a non-linear profile in the direction between opposite sides 14a and 16c of the closure. Preferably, the offset y is between about 0.020 and 0.050 inch. In the embodiment illustrated in FIGS. 2–4, the offset of intermediate closure member 10b relative to outer closure members 10a and 10c is greater than the dimension x of the individual entrance passages 28a, 28b and 28c whereby, as best seen in FIG. 4, finger 34b extends between the opposed fingers 36a and 36c of closure members 10a and 10c. While this overlapping relationship is preferred, for the reason set forth hereinafter, the bag closure will function in accordance with the present invention if the offset y is less than the dimension x of entrances 28a, 28b and 28c, as shown in FIG. 5 of the drawing. As will be appreciated from the latter Figure, an offset less than the dimension of the individual entrances still provides for the entrance passage between opposite sides 14a and 16c of the closure to be non-linear in accordance with the present invention.

The three closure members can be interconnected in any suitable manner and, for example, may be adhesively bonded together or heat sealed, either in the areas of facial engagement therebetween or along the outer peripheral edges thereof. Preferably, for the purpose set forth hereinafter, the three closure members are not interconnected in the areas of fingers 36a, 36b and 36c so that the outer fingers 36a and 36c are free to flex laterally outwardly relative to intermediate finger 36b.

Figure 6:
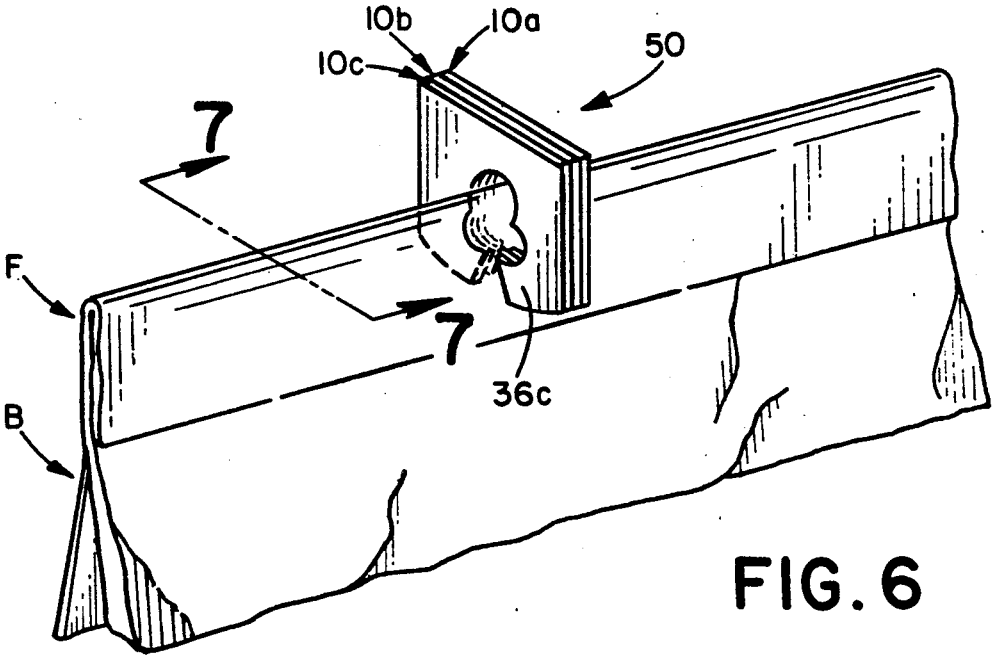
FIG. 6 is a perspective view illustrating the bag closure in FIG. 2 mounted on the closed end of a bag.
Figure 7:
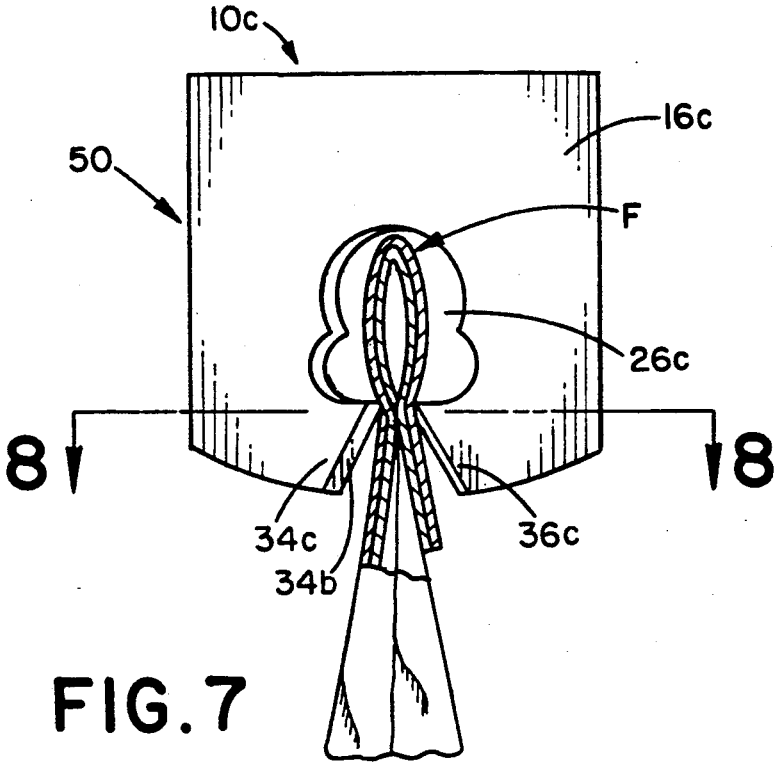
FIG. 7 is an enlarged elevation view of the bag and closure, partially in section, taken along line 7—7 in FIG. 6.
Figure 8:
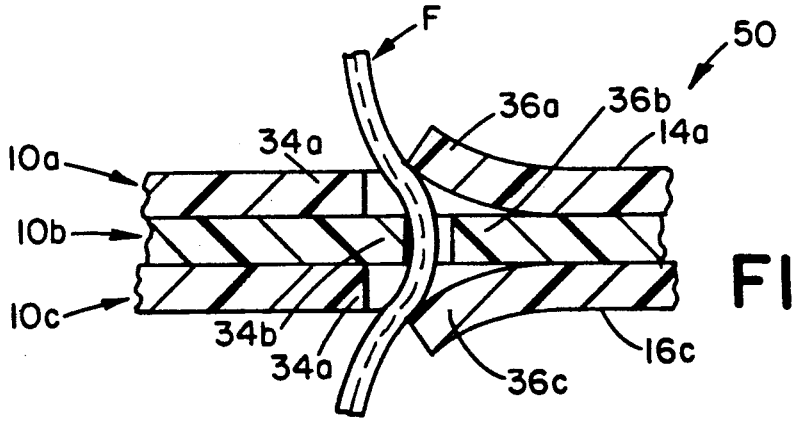
FIG. 8 is a cross-sectional view of the bag and closure taken along line 8—8 in FIG. 7.

Referring now to FIGS. 6–8 of the drawing, bag closure 50 is adapted to be introduced onto the folded closed end F of a paper or plastic bag B by pushing the folded end F through the entrance passage and into the opening through the closure. When introduced onto the folded end of the bag, closure 50 extends transverse to the folded end and, as best seen in FIG. 8, the non-linear profile of the entrance passage distorts bag end F to a similar non-linear contour in the area of the entrance passage to securely hold the closure on the bag end and transverse to the line of the 35 fold. The offset of intermediate closure member 10b relative to outer closure members 10a and 10c, together with the aforementioned flexing capability of fingers 36a and 36c relative to finger 36b, provides for the fingers 36a and 36c to flex outwardly of finger 36b as shown in FIG. 8 to spread or lengthen the entrance passage in the direction between the opposite sides 14a and 16c of the closure. Such displacement of fingers 36a and 36c further stabilizes the closure in its transverse orientation relative to folded end F of the bag, and the resiliency of the material of the fingers promotes retention of the closure on the bag end against sliding displacement therefrom. More particularly in this respect, the offset provides for a three point contact between closure 50 and folded end F of a bag, such three point contact being defined by the finger 34b of intermediate closure member 10b and fingers 36a and 36c of outer closure members 10a and 10c. As will be appreciated from FIG. 8, this three point contact relative to folded end F of the bag provides a center point of contact on one side of the folded end and two points of contact on the opposite sides of the folded end and laterally outwardly of the center point. This stabilizes the interengagement between a closure and bag end so as to maintain the closure transverse to the closed end.

It will be appreciated of courses that the extent to which fingers 36a and 36c flex outwardly relative to intermediate finger 36b is dependent upon the thickness of the paper or plastic bag material, the dimension x of the individual entrance passages of the intermediate and outer closure members, and the dimension y of the offset of intermediate closure member 10b relative to outer closure members 10a and 10c. All of these dimensions are variable, and dimensions x and y will generally be selected on the basis of the thickness or range of thicknesses for a particular bag material with which the closure is intended to be used.

Figure 9:
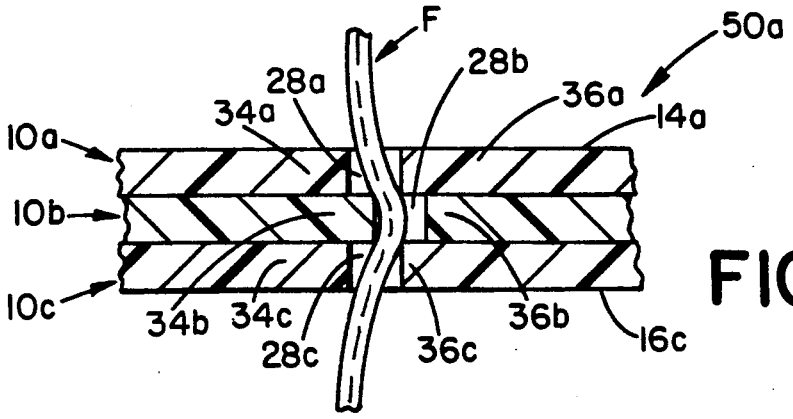
FIG. 9 is a cross-sectional view similar to FIG. 8 and showing the bag and closure interrelationship using the closure in FIG. 5.

While it is preferred as described above to provide for the offset dimension y to be greater than the dimension x for the entrance passages of the individual closure members, the desired three point contact and the resulting non-linear contour of the bag end can be achieved when the offset y is less than the dimension x as shown in FIG. 5 in connection with a closure 50a. The latter closure is identical to closure 50 shown in FIGS. 2–4, except for the offset dimension y. FIG. 9 shows the interrelationship between a bag end F and closure 50a when the latter is introduced onto the bag end as shown in FIG. 6 with regard to closure 50. As will be appreciated from FIG. 9, the offset of intermediate closure member 10b provides for the entrance passage between opposite sides 14a and 16c of the closure to be non-linear, whereby the bag end F is distorted to a similar non-linear contour. Further, finger 34b of intermediate closure member 10b and the opposed fingers 36a and 36c of the outer closure members 10a and 10c provide the three point contact with the bag end by which the closure is stabilized in its position transverse to the folded bag end.

Figure 10:
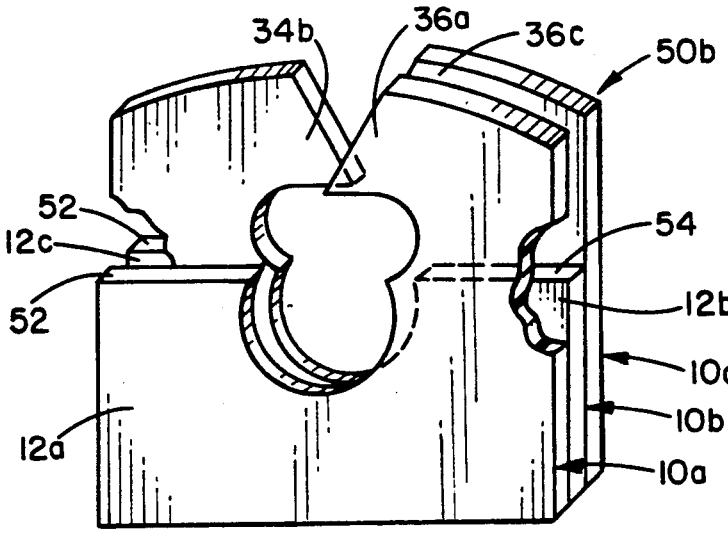
FIG. 10 is a perspective view of another embodiment of a closure in accordance with the present invention.

FIG. 10 illustrates another embodiment of a bag closure according to the invention, designated generally by the numeral 50b. Closure 50b is a structural modification of closure 50 illustrated in FIGS. 2–4, whereby like numerals are used in FIG. 10 to designate the corresponding part. In the embodiment illustrated in FIG. 10, the body portions 12a and 12c of outer closure members 10a and 10c are modified by cutting each of the body portions along a line 52, thus to remove fingers 34a and 34c thereof, respectively. Similarly, body portion 12b of intermediate closure line 54, thus to remove finger 36b therefrom. As will be appreciated from FIG. 10, this structure provides for the entrance passage between the opposite sides of the closure to be defined by the inner ends of outer fingers 36a and 36c and the inner end of intermediate finger 34b which extends therebetween.

As will be appreciated from FIG. 8, when closure 50*b* is introduced onto a bag end, fingers 36*a* and 36*c* flex laterally outwardly relative to finger 34*b* and the bag end is distorted to a non-linear contour by the three point engagement defined by intermediate finger 34*b* and outer fingers 36*a* and 36*c*.

Figure 11:
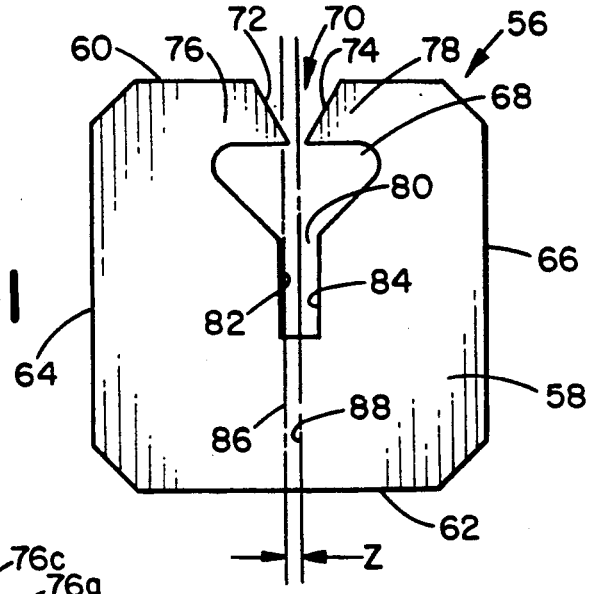
FIG. 11 is an elevation view of another embodiment of a single ply closure member for making a closure in accordance with the present invention; and, FIG. 12 is a perspective view of a bag closure constructed from closure members of the structure shown in FIG. 11.
Figure 12:
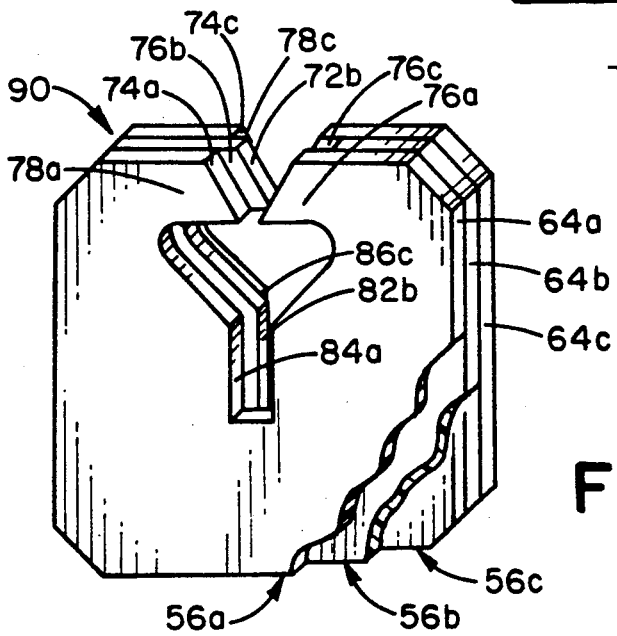

FIGS. 11 and 12 of the drawing respectively illustrate a modified closure member 56 and a closure in accordance with the present invention constructed therefrom. Closure member 56 is similar to closure member 10 with respect to the width, height and thickness dimensions thereof and the materials from which the member can be fabricated. The primary difference, as described more fully hereinafter, is that the entrance passage to the opening through the closure member is offset from the centerline between the end edges of the closure member. More particularly, closure member 56 includes a body portion 58 having planar opposite sides, not designated numerically, and a peripheral edge which includes a top edge 60, a bottom edge 62 and opposite end edges 64 and 66. An opening 68 is provided through the body portion between the opposite sides thereof, and an entrance passage 70 is provided for opening 68 from top edge 60. Access to entrance passage 70 from edge 60 is provided by inclined walls 72 and 74 which converge in the direction from edge 60 toward opening 68 and intersect the opening to provide the body portion with opposed fingers 76 and 78 which define entrance passage 70. The inner ends of fingers 76 and 78 are spaced apart and, as mentioned hereinabove by way of example, such spacing may be from about 0.022 to 0.032 inch.

Body portion 58 is provided with a slot 80 extending from opening 68 in alignment with entrance passage 70. Slot 80 has parallel side edges 82 and 84 perpendicular to top edge 60 and spaced apart to provide the slot with a width for receiving the closed end of a bag therebetween as explained hereinafter. Such width, for example, may be about 0.1 inch. Importantly in connection with this embodiment, body portion 58 of the closure member has a center line 86 between end edges 64 and 66 and which provides a center point between the opposite ends of the top edge 60, and entrance passage 70 has a centerline 88 which is offset a distance z from centerline 86 in the direction towards end edge 66 of the body portion. Centerline 88 is also the centerline for slot 80, whereby the slot is also offset the distance z towards end edge 66. The dimension z is preferably from about 0.01 to 0.025 inch and, as will become apparent hereinafter, is equal to one-half the offset desired in connection with the non-linear entrance passage for a closure constructed from the closure members 56.

FIG. 12 illustrates a bag closure 90 constructed from three of the closure members 56 which are designated 56*a*, 56*b* and 56*c*. As will be appreciated from FIG. 12, the three closure members are disposed in side-by-side relationship with the orientation of outer closure members 56*a* and 56*c* reversed relative to that of intermediate closure member 56*b*, whereby end edges 64*a* and 64*c* of the outer members and end edge 66*b* of the intermediate member are at the same end of closure 90. The reverse orientation, together with the offset z between the entrance passage and centerline of the individual closure members provides for finger 76*b* of the intermediate closure member to be offset relative to and to extend between fingers 76*a* and 76*c* of the outer closure members. It will be further appreciated that the reversed orientation provides for the offset between the entrance passages of the outer closure members and the entrance passage of the intermediate closure member to be twice the dimension z for the individual closure members. The reverse orientation likewise provides for the side edges of the slots 80 in the individual closure members to be offset as shown in FIG. 12.

Advantageously, the construction of a bag closure from closure members 56 in the foregoing manner eliminates the need to trim the opposite end edges of the individual closure members as is necessary when the entrance passage is symmetric to the end edges of the individual closure member. A further advantage with respect to bag closure 90, which is applied to the folded closed end of a paper or plastic bag in the manner described hereinabove in conjunction with FIGS. 6–8, is that the slot is of a width between the side edges thereof which closely accommodates the uppermost end of the folded bag material to further stabilize the retention of the closure on the bag and the orientation thereof transverse to the folded end of the bag.

While considerable emphasis has been placed on preferred embodiments herein illustrated and described, it will be appreciated that many embodiments of the invention can be made and that many changes can be made in the embodiments disclosed herein without departing from the principles of the invention. In this respect, for example, the inner ends of the fingers providing the entrance passage can be rounded or flat rather than pointed as shown herein. Moreover, by rounding or beveling the inner ends of the fingers relative to the opposite sides of the individual closure members, the non-linear profile of the entrance passage can have a sinusoidal or sawtooth contour rather than the square tooth contour illustrated. Further, the bag closure can be of one piece construction, formed for example by injection molding, to have a thickness corresponding to the thickness of the tri-laminate construction with the non-linear entrance passage either formed in conjunction with the molding process or by cutting following the molding process. Still further, the outer peripheral contour of the bag closure can be other than the generally square contour shown and in this respect could, for example, be round. The foregoing and other modifications of the preferred embodiments as well as other embodiments of the invention will be obvious or suggested from the disclosure herein, whereby it is to be distinctly understood that the foregoing descriptive matter is to be interpreted merely as illustrative of the present invention and not as a limitation.

Having thus described the invention it is claimed:

1. A bag closure comprising body means having planar opposite sides and an edge between said sides, an opening through said body means between said sides, means including opposed finger means on said body means providing entrance passage means to said opening from said edge, said opposed finger means including at least two planar fingers each in a corresponding plane coplanar with a different one of said opposite sides and a third planar finger in a plane between and contiguous with the planes of said two planar fingers, said opposed finger means providing for said entrance passage means to extend between and intersect said sides and to have a non-linear profile in the direction between said sides.

2. A bag closure according to claim 1, and a slot in said body means extending from said opening in the direction away from said entrance passage means.

3. A bag closure according to claim 1, wherein said two fingers overlap said third finger in the direction between said opposed finger means.

4. A bag closure according to claim 1, wherein said at least two fingers are displaceable laterally outwardly relative to the plane of said third finger.

5. A bag closure according to claim 4, wherein said two fingers overlap said third finger in the direction between said opposed finger means.

6. A bag closure according to claim 5, and a slot in said body means extending from said opening in the direction away from said entrance passage means.

7. A bag closure comprising body means having opposite sides and an edge between said sides, an opening through said body means between said sides, opposed finger means on said body means providing entrance passage means to said opening from said edge, said entrance passage means extending between said sides and having a non-linear profile in the direction between said sides, said opposed finger means including three pairs of opposed fingers, each said pair of fingers being in corresponding plane parallel to said opposite sides of said body means and on opposite sides of said entrance passage means whereby a bag can pass between them.

8. A bag closure according to claim 7, wherein the outermost pairs of opposed fingers are in alignment in the direction transverse to said opposite sides and the intermediate pair of opposed fingers are offset relative to said outermost pairs in the direction between said opposed finger means.

9. A bag closure according to claim 8, and a slot in said body means extending from said opening in the direction away from said entrance passage means.

10. A bag closure according to claim 8, wherein said offset provides for said outermost and intermediate pairs of opposed fingers to overlap in said direction between said opposed finger means.

11. A bag closure according to claim 8, wherein the outermost fingers on at least one side of said entrance passage means are displaceable laterally outwardly relative to the plane of the intermediate finger on the corresponding side of said entrance passage means.

12. A bag closure according to claim 11, wherein said offset provides for said outermost and intermediate pairs of opposed fingers to overlap in said direction between said opposed finger means.

13. A bag closure according to claim 12, and a slot in said body means extending from said opening in the direction away from said entrance passage means.

14. A bag closure comprising body means defined by a pair of outer body members and an intermediate body member, said body members each being of generally planar plastic material and being interconnected in parallel relationship to provide said body means with opposite sides and edge means between said opposite sides, said outer and intermediate body members including means providing said body means with an opening therethrough between said sides, and said outer and intermediate body members including means providing said body means with an entrance passage to said opening from said edge means, said entrance passage having a non-linear profile in the direction between said opposite sides of said body means.

15. A bag closure according to claim 14, and said outer and intermediate body members including means providing said body means with a slot extending from said opening in the direction away from said entrance passage.

16. A bag closure according to claim 14, wherein said means providing said body means with an entrance includes finger means on said intermediate body member and opposing finger means on each said outer body.

17. A bag closure according to claim 16, wherein said finger means on said intermediate body member extends between said opposing finger means on said outer body members.

18. A bag closure according to claim 16, wherein said opposing finger means on each said outer body member is displaceable laterally outwardly relative to the plane of said intermediate body member.

19. A bag closure according to claim 18, and said outer and intermediate body members including means providing said body means with a slot extending from said opening in the direction away from said entrance passage.

20. A bag closure according to claim 18, wherein said finger means on said intermediate body member extends between said opposing finger means on said outer body members.

21. A bag closure according to claim 20, and said outer and intermediate body members including means providing said body means with a slot extending from said opening in the direction away from said entrance passage.

22. A bag closure comprising three body members, each said body member being of generally planar plastic material and having opposite sides and an edge between said sides, an opening between said sides and an entrance to said opening from said edge, said entrance having a centerline parallel to and offset from a line bisecting said edge, and said three body members being interconnected in parallel side-by-side relationship with the centerline of said entrance in the intermediate one of said body members reversed with respect to the centerline of the entrances in the outer two body members.

23. A bag closure according to claim 22, and a slot in each said body member extending from said opening in alignment with said entrance.

24. A bag closure according to claim 23, wherein said slot has parallel side edges parallel to said centerline of the entrance in the corresponding body member.

25. A bag closure member of generally planar plastic material having opposite sides and an edge between said sides, an opening between said sides, and an entrance to said opening from said edge, said entrance having a centerline parallel to and offset from a line which both bisects said edge and intersects said opening.

26. A gab closure member according to claim 25, and a slot in said closure member extending from said opening in alignment with said entrance.

27. A bag closure member according to claim 26, wherein said slot has parallel side edges parallel to said centerline of said entrance.

28. A bag closure comprising body means of plastic material having opposite sides and an edge between said sides, an opening through said body means between said sides, said body means including opposed planar finger means parallel to said sides and providing entrance passage means to said opening from said edge, said entrance passage means extending between said sides and having a non-linear profile in the direction between said sides, and said body means being relatively rigid in the direction between said opposed finger means so as to support said opposed finger means against separation in said direction between said opposed finger means while permitting lateral deflection of said finger means in the direction between said sides.

* * * * *